United States Patent [19]

Forsgren et al.

[11] Patent Number: 5,063,926

[45] Date of Patent: Nov. 12, 1991

[54] RESPIRATOR CARTRIDGE WITH SEALANT DISPERSION MEMBER

[75] Inventors: R. David Forsgren, Bloomington; Henry J. Drasner, III, Edina; Roy E. Fielder, St. Louis Park, all of Minn.

[73] Assignee: Donaldson Company, Inc., Bloomington, Minn.

[21] Appl. No.: 508,856

[22] Filed: Apr. 12, 1990

[51] Int. Cl.[5] ..... A62B 18/08; A62B 7/10; A62B 23/02; A62B 19/00

[52] U.S. Cl. ..... 128/206.17; 128/205.27; 128/205.29; 55/DIG. 35; 55/DIG. 33

[58] Field of Search ..... 128/201.25, 205.27, 128/205.28, 205.29, 206.17; 55/DIG. 35, DIG. 33, 497, 498, 499

[56] References Cited

U.S. PATENT DOCUMENTS

| | | | |
|---|---|---|---|
| 1,536,857 | 5/1925 | Hudson . | |
| 1,781,254 | 11/1930 | Stelzner . | |
| 2,269,461 | 1/1942 | Lehmberg | 128/146 |
| 2,798,483 | 7/1957 | Kashima | 128/146 |
| 3,944,403 | 3/1976 | Simpson et al. | 55/316 |
| 4,154,586 | 5/1979 | Jones et al. | 55/274 BN |
| 4,543,112 | 9/1985 | Ackley et al. | 55/316 |
| 4,548,626 | 10/1985 | Ackley et al. | 55/316 |
| 4,686,976 | 8/1987 | Bakkila et al. | 128/206.15 |
| 4,714,486 | 12/1987 | Silverthorn | 55/316 |

*Primary Examiner*—J. Reed Fisher
*Assistant Examiner*—Kimberly Asher
*Attorney, Agent, or Firm*—Merchant, Gould, Smith, Edell, Welter & Schmidt

[57] ABSTRACT

A respirator cartridge having body, cover and filter media elements, and including a sealant dispersion member in one of the body or cover elements. The dispersion member directs the sealant material to the peripheral edge of the filter media without wetting the filtering surface of the media. An improved method for rotational molding filter media in/or for a filter assembly is also provided.

10 Claims, 4 Drawing Sheets

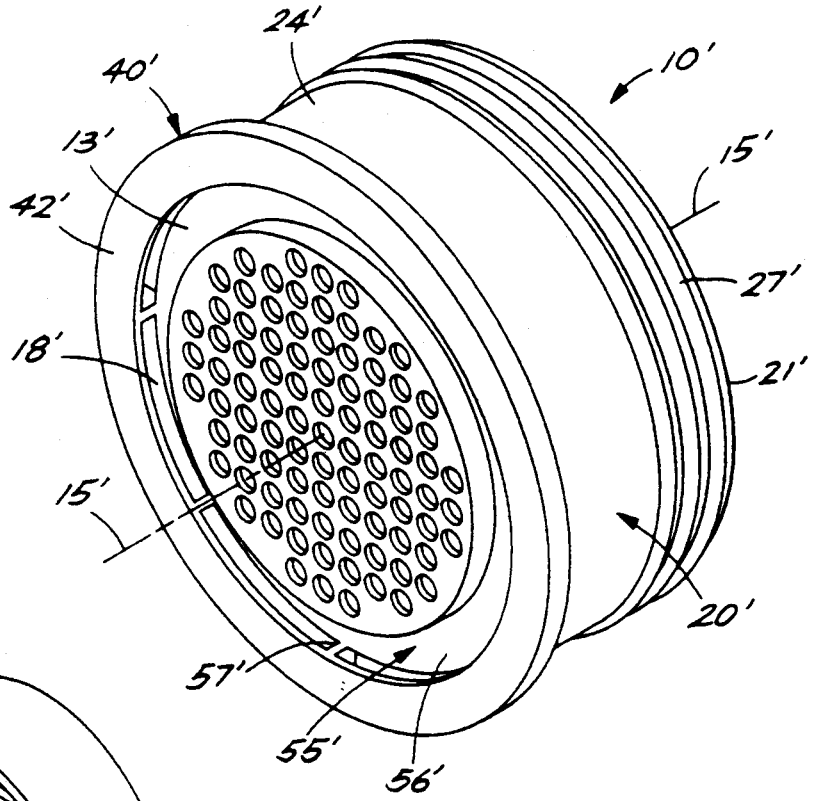
FIG. 8
FIG. 6
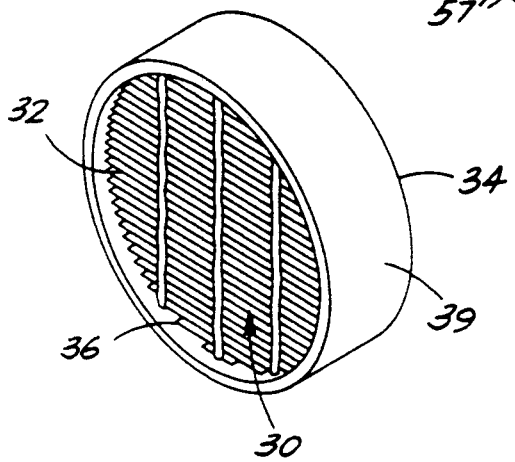
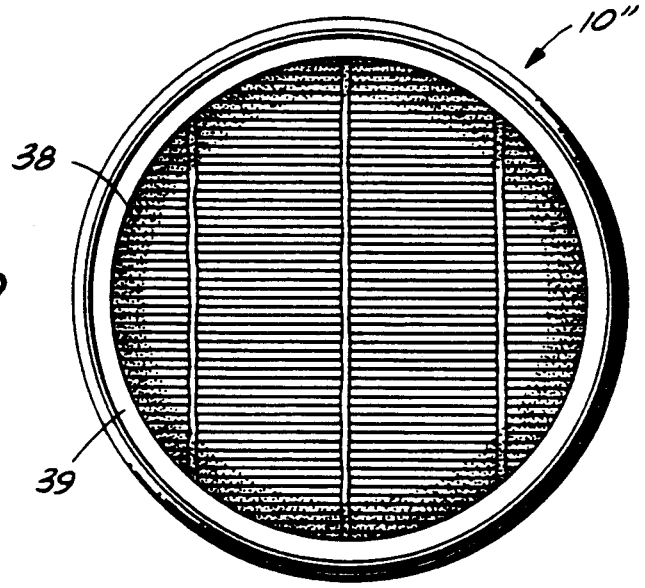
FIG. 10

RESPIRATOR CARTRIDGE WITH SEALANT DISPERSION MEMBER

FIELD OF THE INVENTION

The present invention relates to an improved respirator cartridge and method to form the improved respirator cartridge using a spin potting process.

BACKGROUND OF THE INVENTION

Use of respirators is required in a wide range of industrial environments including chemical, nuclear and biomedical facilities. Various types of respirators are known and currently employed. For example, respirator units including single or double respirator cartridges secured to a face mask or hood are commonly used. In some applications, respirator cartridges include high efficiency particulate air media (HEPA) certified by the National Institute for Occupational Safety and Health (NIOSH). These filters are capable of filtering out at least 99.97% of the particulates from a given test sample. HEPA media can be used alone in respirator cartridges or used in combination with a charcoal component which can react with and remove hazardous vapors and gases.

One form of respirator cartridge is shown in U.S. Pat. No. 4,714,486. This form of filter cartridge includes a radially pleated filter media which meets the high efficiency particulate air filter requirements of NIOSH. The radially pleated filter media enclosed in respirator cartridges of this type is secured within the cartridge structure by a perimeter seal of potting material. Commonly, the seal is formed using a rotational molding technique in which the sealant material is dispensed at or near the peripheral edge of the filter media where it cures in place while the respirator cartridge spins.

There are a number of problems associated with current rotational molding techniques. For example, the sealant material dispensed at the perimeter of the filter media has a tendency to dam-up between the respirator body and the edge of the filter media. Consequently, the sealant material flows inwardly over the filtering surface of the media thus reducing the overall efficiency and useful life of the respirator cartridge. Current in-place spin sealing methods are also not suitable for forming self supporting sealed filter elements. This precludes production of separate filter elements that can be assembled into new or existing respirator cartridges.

Therefore, a need exists for an improved respirator cartridge having a sealed filter media element and an improved rotational molding process for making respirator cartridges.

SUMMARY OF THE INVENTION

The present invention relates to an improved air filter assembly or cartridge for a respirator. In a preferred embodiment, the respirator cartridge includes a body element, a cover element, and a filter media element enclosed between the body and cover elements. According to the present invention, one of the body element or cover element has an orifice including a sealant dispersion member mounted therein. When assembled, the peripheral edge of the filter media is secured to a side wall segment of the body by a layer of cured sealant material which has been delivered uniformly to the peripheral edge of the filter media by the dispersion member.

Most preferably, the sealant dispersion member is an integral molded grid centrally positioned below the orifice in a substantially cylindrical body element, thereby forming a space between an outer surface of the grid and the inside edge of the orifice. In another embodiment of the present invention, the dispersion member is integrally molded in an orifice of the cover element.

According to one aspect of the invention, the respirator cartridge is made by an improved rotational molding or spin potting process using a spin fixture. First, the body element, cover element and filter media element of the respirator cartridge are positioned in a retaining member with the center axis of the respirator cartridge orientated vertically. The respirator cartridge is then spun in place using centrifugal force at a rate effective to direct potting material to the peripheral edge of the filter media element without wetting the filtering surface of the filter media. Sufficient sealant material is dispensed into the dispersion member of the spinning respirator cartridge assembly, forming a seal along the peripheral edge of the filter media. This seal is allowed to cure, thereby affixing the filter media to the body element of the respirator cartridge. The resulting structure exhibits a filtering surface substantially free of undesired sealant material.

According to another aspect of the invention, a mold component is provided, such mold component being useful in rotational molding to form a self-supporting substantially cylindrical filter element having a sealed peripheral outer edge which can be used as a component of a respirator cartridge. Finally, the self-supporting, substantially cylindrical filter element itself is an aspect of the present invention.

These and other advantages and features of novelty which characterize the invention are pointed out with particularity in the claims annexed hereto, and forming a part hereof. However, for a better understanding of the invention, its advantages and objects attained by its use, reference should be had to the drawings which form a further part hereof and to the accompanying descriptive matter in which there is illustrated and described a preferred embodiment of the invention.

BRIEF DESCRIPTION OF THE FIGURES

In the drawings, in which like reference numerals indicate corresponding parts throughout the several views:

FIG. 6 is a perspective view of a self-supporting filter media element made according to the present invention.

FIG. 8 illustrates another form of respirator cartridge made in accordance with the present invention.

FIG. 10 is a drawing of a prior art type respirator cartridge having a filter element affixed to a body with sealant directly dispensed at the edge of the filter element.

DETAILED DESCRIPTION OF THE INVENTION

Figure 1:
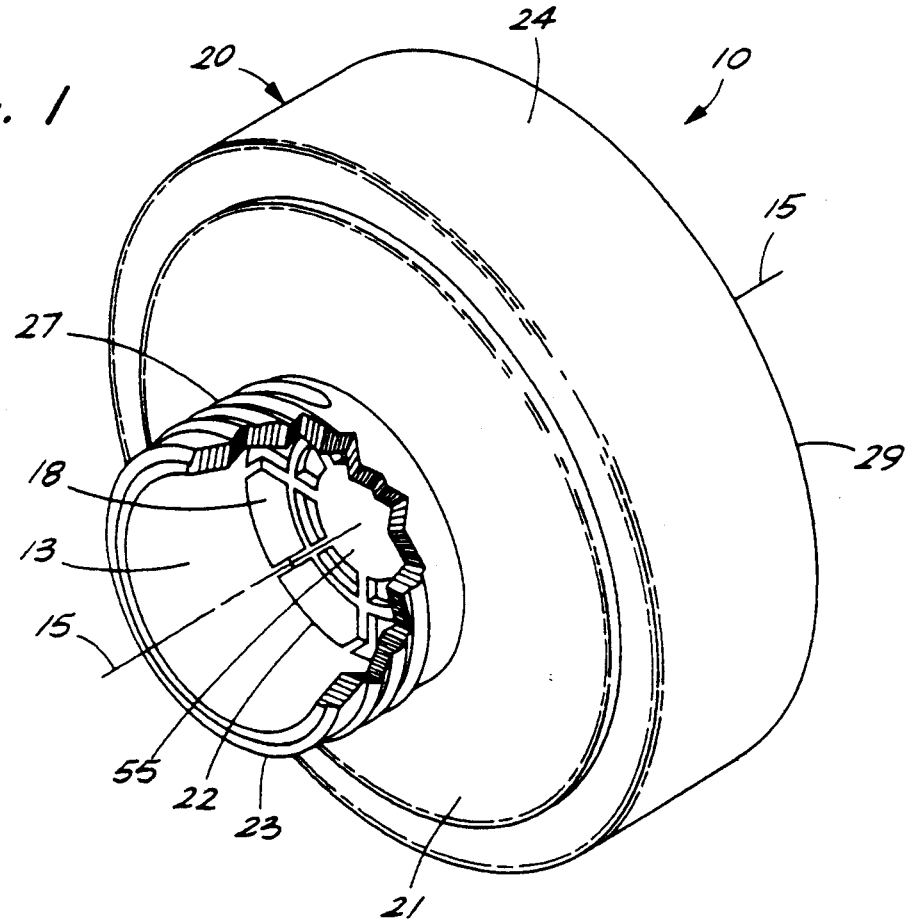
FIG. 1 is a perspective view of one form of a respirator cartridge made in accordance with the principles of this invention.

Referring now to the drawings, there is shown in FIGS. 1-5 a preferred embodiment of the present invent generally referred to by the reference numeral 10. As is illustrated, the preferred embodiment of the present invention has three components; a body element 20, a cover element 40, and a filter media element 30. When assembled into respirator cartridge 10, body element 20, cover element 40 and filter media element 30 are aligned along a center axis 15.

In the preferred embodiment, body element 20 of the present invention 10 has a substantially cylindrical shape with a first end 21 and a second end 29 and a periphery defining side wall segment 24.

Figure 3:
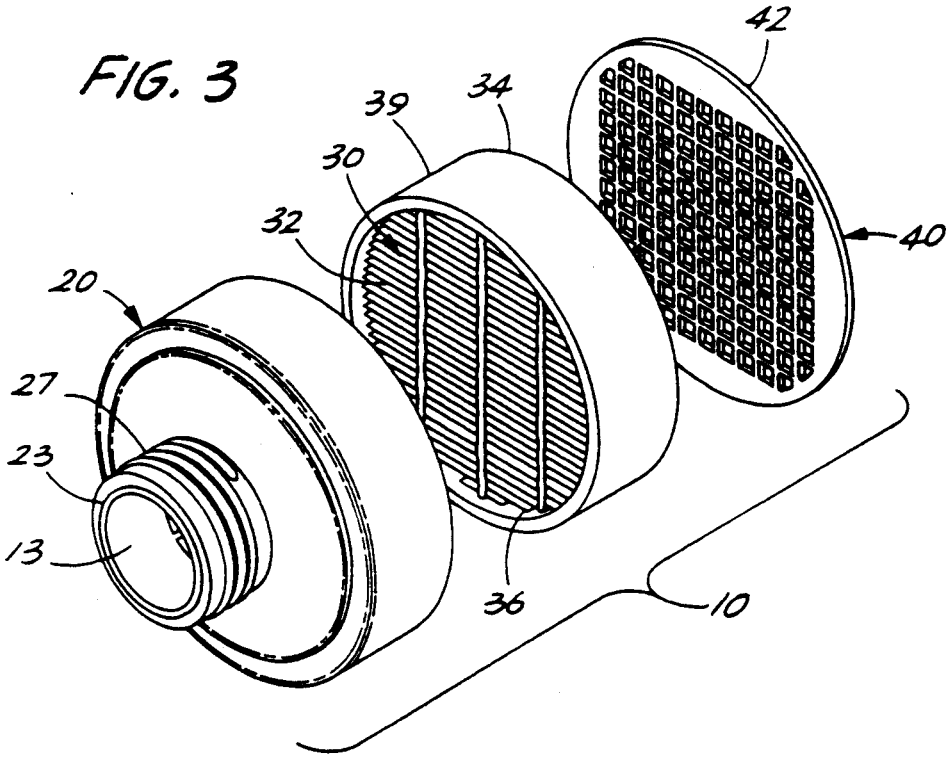
FIG. 3 is an exploded view of the respirator cartridge shown in FIG. 1.
Figure 5:
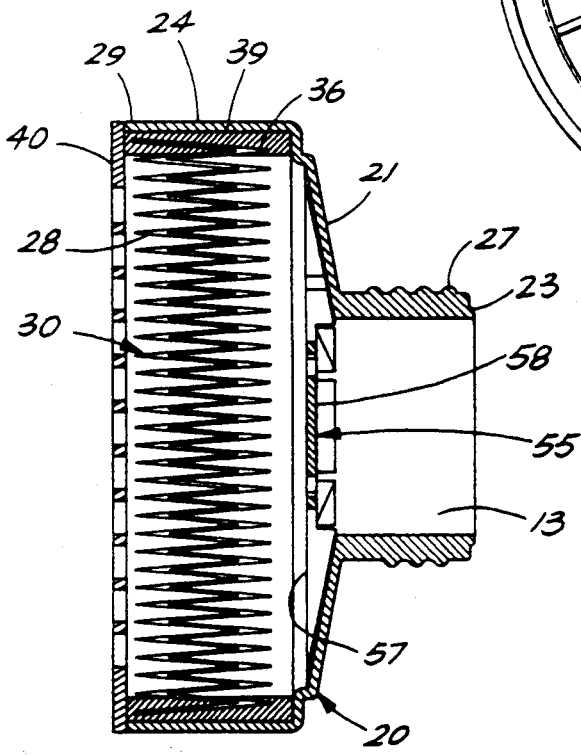
FIG. 5 is a section view taken generally along the line 5—5 in FIG. 2.

As best seen in FIGS. 1, 3 and 5, body element 20 includes an orifice 13 at the first end 21 of body element 20. Orifice 13 is defined by a neck 23 that is threaded 27 to facilitate attachment to a face mask or hoodlike type respirator assembly (not shown).

Figure 2:
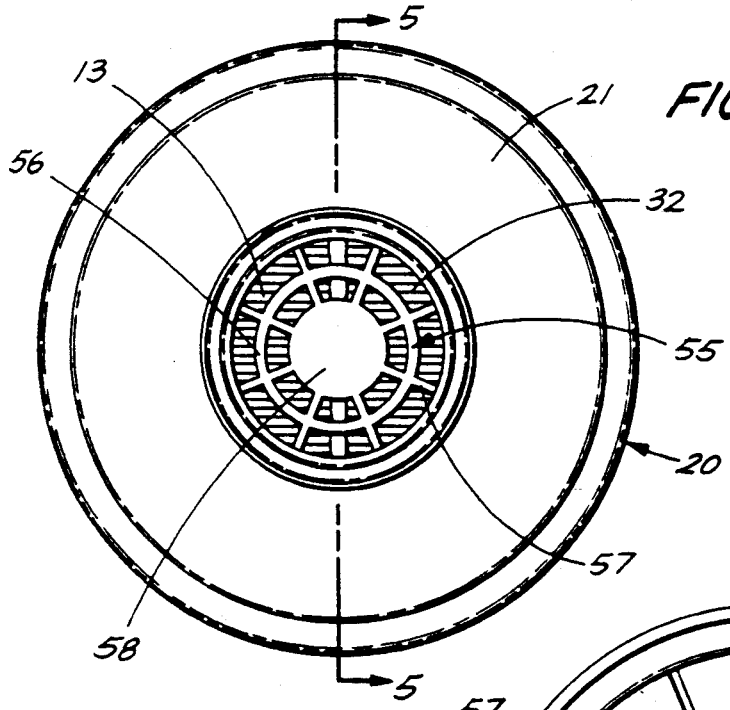
FIG. 2 is an end view of the respirator cartridge as shown in FIG. 1.
Figure 4:
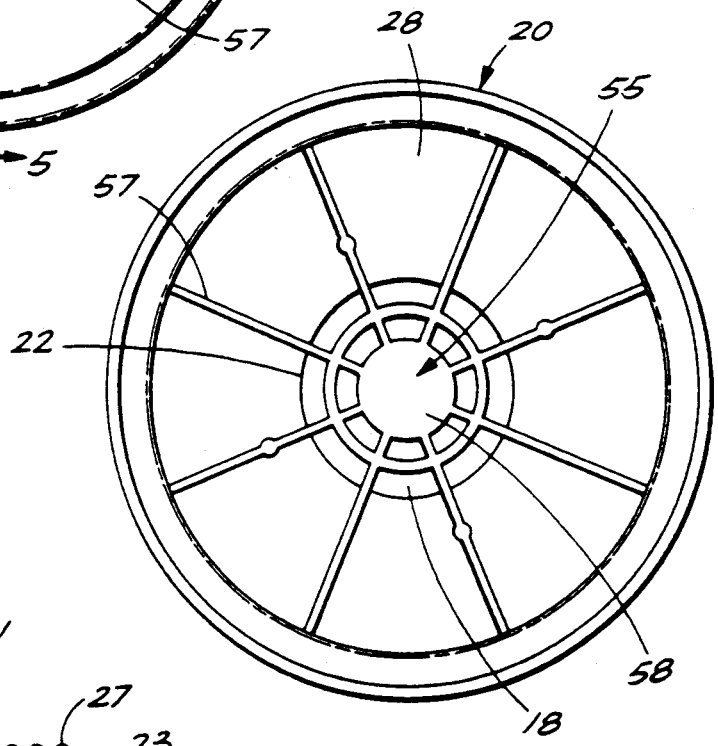
FIG. 4 is a bottom view of the body element of the respirator cartridge shown in FIG. 1.

Referring to FIGS. 2, 4, and 5, body element 20 includes a sealant dispersion member 55 having a grid-like configuration mounted in orifice 13 by radially extending spacing arms 57. As best seen in FIGS. 2, 4, and 5 in the preferred embodiment, the dispersion grid 55 has a solid sealant directing center section 58. Dispersion member 55 is coaxially aligned with and recessed from first end 21. Specifically, the dispersion grid 55 is positioned below the orifice 13 forming a space 18 between the outer surface 56 of grid 55 and an inside edge 22 of neck 23. As seen in FIGS. 1-5, preferably the dispersion grid 55 is integrally molded to the cartridge body element 20; however, dispersion grid 55 can be detachably mounted in orifice 13.

As best seen in FIG. 3, the respirator cartridge 10 includes a substantially circular cover element 40 which is affixed to the second end 29 of body element 20 enclosing a filter media element 30 therebetween, thus forming respirator cartridge 10. In one preferred embodiment, body element 20 and cover element 40 are preformed from thermo-plastic material and are ultrasonically welded together. Alternatively, body element 20 and cover element 40 can be constructed from materials that can be snap locked or adhesively bonded.

In the preferred embodiment, the filter media element 30 of respirator cartridge 10 is a substantially cylindrical HEPA filter media. However, it will be appreciated that filter media of various efficiencies can be used depending on the particular environment of use for the respirator cartridge 10. The filter element 30 includes an inner filtering surface 32, an outer filtering surface 34 and a peripheral side edge 36. Referring to FIG. 3, inner surface 32 is aligned substantially parallel with and aligned proximate to the dispersion grid 55. Outer surface 34 is aligned substantially parallel with and proximate to the cover element 40. In the preferred embodiment, peripheral edge 36 is secured to side wall segment 24 by a layer of uniformly dispersed and cured sealant or potting material 38. The layer of sealant material forms a sealed edge 39 that secures side edge 36 to the inner surface of side wall segment 24. The seal is spun in place using centrifugal force as will be described below. The sealant material used to secure filter media element 30 can be one of many organic polymers such as polyurethane epoxide or plastisol. A preferred sealant material is polyurethane.

Figure 9:
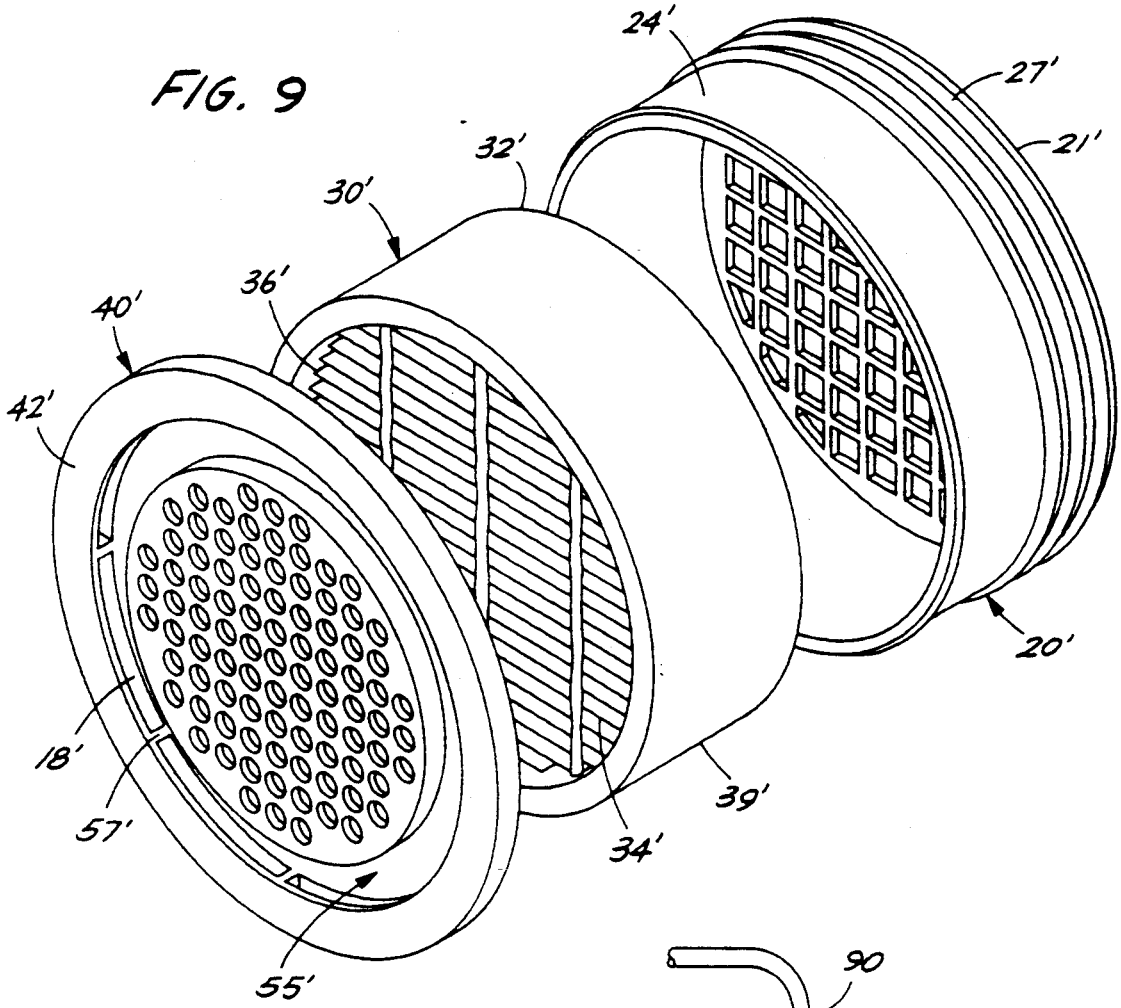
FIG. 9 is an exploded view of the alternate form of respirator cartridge shown in FIG. 8.

In an alternate embodiment of the present invention shown in FIGS. 8 and 9, a respirator cartridge 10, includes a body element 20' and cooperatively shaped cover element or cap 40' which enclose a filter element 30'. Referring to FIGS. 8 and 9, dispersion member 55' is a substantially circular ring structure coaxially aligned with center axis 15' respirator cartridge 10' in orifice 13'. The dispersion ring 55' is integrally molded to the cover element 40' by support arms 57' which recess the dispersion ring 55' from the outer surface 42' of cover element 40', thereby forming a space 18' through which sealant material can be delivered to the peripheral edge 36' of filter media element 30'.

As seen in FIG. 8, inner end 21' of body element 20' includes threads 27' for attachment of the respirator cartridge 10' to a filtering mask or hood (not shown). As in the preferred embodiment shown in FIGS. 1-5, in the alternate embodiment of FIGS. 8 and 9, filter media element 30' has a sealed edge 39' formed at the peripheral edge 36' by sealant material 38. Sealed edge 39' serves to secure filter media element 30' to side wall segment 24'. In the alternate embodiment shown in FIGS. 8 and 9, outer surface 34' of the filtering media 30' is aligned substantially parallel with and proximate to the cover element 40' and the inner surface 32' is aligned substantially parallel with and proximate to the inner end 21' of the body element 20'.

In both the preferred and alternate embodiments shown, the dispersion member 55, 55' provides a directing surface for delivering sealant material 38 to the peripheral side edge 36, 36' of the filter media 30, 30' when the filter cartridge 10, 10' is subjected to centrifugal force during a rotational molding process.

Figure 7:
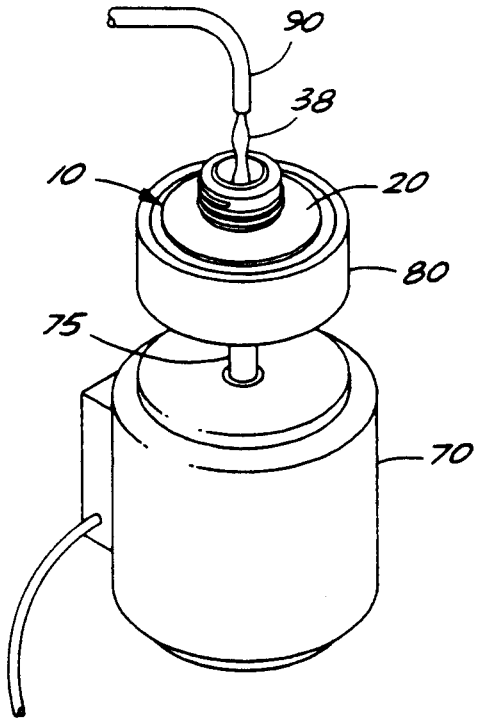
FIG. 7 is a drawing of an apparatus for making respirator cartridges in accordance with the method of the present invention.

In FIG. 7 a drawing of a sample apparatus for making respirator cartridges including dispersion member 55 is shown. It is to be understood that one skilled in the art can apply the principles of the present invention to make rotational molding apparatuses having components specifically designed for mass production of respirator cartridges of various dimensions and for self-supporting sealed filter media elements. As seen in FIG. 7, a respirator cartridge 10 including body element 20, filter media element 30 and cover element 40 are positioned in spin fixture 80 with the center axis 15 of respirator cartridge 10 orientated vertically. The spin fixture 80 including respirator cartridge 10 is then rotated by motor 70 and connecting rod 75 at a rate effective to direct sealant material 38 to the peripheral edge 36 of filter media 30 without wetting the filtering surface 32. The specific rate of rotational movement necessary to direct the sealant material to the peripheral edge 36 of the media will vary depending on the size of filter element to be secured in the respirator cartridge. For example, with a respirator cartridge having a diameter of 3 inches, the rate of rotational velocity needed to propel the sealant material to the peripheral edge 36 of the media 30 in the respirator cartridge 10 is about 800 to 1000 revolutions per minute.

To secure the filter media 30 in the respirator cartridge 10 sufficient sealant material 38 is dispensed into the recessed grid member 55 to form a sealed edge 39. The amount of sealant material necessary to form the sealed edge 39 will vary, again depending on the dimensions of the respirator cartridge elements. By way of example, in a respirator cartridge having a diameter of 3 inches, the sealed edge 39 can vary in width from about 1.5 to about 3.0 millimeters. Preferably, the thickness of the sealed edge will vary from about 2.0 to about 2.25 mm.

The respirator cartridge is allowed to spin in fixture 80 for a period of time sufficient for the sealed edge 39 to be formed and cure to affix the filter media element 30 to the body element 20. While the time necessary to cure will vary depending upon the composition of that material, in the case of polyurethane the spin fixture 80 is rotated for approximately one to five minutes to allow for sufficient curing before removal of the respirator cartridge 10 from the apparatus.

Respirator cartridges formed in accordance with the method described above exhibit minimal sealant material on the filtering surfaces of the filter media element 30. This is in contrast to the undesired deposit of sealant material 38 on the filter media when sealant material is injected at the perimeter of a respirator filter member directly, as exemplified by the prior art type respirator cartridge component 10" shown in FIG. 10.

The rotational molding method described above employing dispersion member 55 can be used to form self-supporting cylindrical filter media elements having a sealed peripheral outer edge. It is envisioned that filter media elements as seen in FIG. 6 can be used in assembly of new respirator cartridges as well as replacement filter media elements for existing respirator cartridges. To form self-supporting filter media elements 30 having a sealed peripheral outer edge 39 the method described above is employed using a mold component having a structure similar to body element 20 seen in FIGS. 1–5. Such mold components can be constructed of appropriate metal and/or plastic materials known to those skilled in the art.

It must be understood, however, that even though numerous advantages and characteristics of the invention have been set forth in the foregoing description, together with details of the structure and function of the invention, the disclosure is illustrative only, and changes may be made in detail, especially in matter of shape, size, and material of components within the principles of the invention, to the full extent indicated by the broad general meaning of the terms in which the appended claims ar expressed.

What is claimed is:

1. A respirator cartridge comprising:

(a) a substantially cylindrical body element having a first end, a second end, and a periphery defining side wall segment;

(b) a cooperatively shaped cover element affixed to said second end of said body element;

(c) a sealant dispersion member mounted in an orifice of one of said body or cover elements; and (d) a substantially between said body and cover elements, said filter element having substantially parallel inner and outer filtering surfaces and a peripheral edge between said inner and outer surfaces, one of said inner or outer surfaces aligned substantially parallel with and proximate to said dispersion member, said peripheral edge secured to said side wall segment by uniformly dispersed and cured sealant.

2. The respirator cartridge of claim 1 wherein said dispersion member is integrally molded to said body or cover element.

3. The respirator cartridge of claim 1 wherein said dispersion member is mounted in said body element and recessed from the first end of said body element.

4. The respirator cartridge of claim 1 wherein said cover element is a substantially circular cap.

5. The respirator cartridge of claim 4 wherein said dispersion member is mounted in said cap.

6. A respirator cartridge comprising:

(a) a substantially cylindrical body element with a center axis and having a first end, defining an orifice, a second end, a periphery defining side wall segment extending from said first end to said second end, and a sealant dispersion member coaxially aligned with and recessed from said first end;

(b) a cover element affixed to said second end of said body element and enclosing a substantially cylindrical filter element therebetween; and (c) said filter element having outer and inner filtering surfaces and a peripheral side edge, said inner surface aligned substantially parallel with said dispersion member and said outer surface aligned substantially parallel with and proximate to said cover element, said side edge secured to said side wall segment by uniformly dispersed and cured sealant.

7. The respirator of claim 6, wherein said orifice is defined by a threaded neck at said first end.

8. The respirator of claim 6, wherein the filter media element is pleated.

9. The respirator of claim 6, wherein said dispersion member is an integrally molded grid pattern centrally positioned below said orifice forming a space between an outer surface of said grid pattern and the inside edge of said orifice.

10. A respirator cartridge comprising:

(a) a substantially cylindrical body element having a first end, a second end and a periphery defining side wall segment extending from said first end to said second end; and (b) substantially circular cover element affixed to said second end of said body element and having an orifice with a sealant dispersion member mounted therein;

(c) a cylindrical filter element enclosed between said body element and cover element, said filter element having inner and outer filtering surfaces and a peripheral edge between said inner and outer surfaces, said inner surface aligned substantially parallel with and proximate to said first end of said body and said outer surface substantially parallel with and proximate to said dispersion member of said cover, said peripheral edge secured to said side wall segment by uniformly dispersed and cured sealant.

* * * * *

UNITED STATES PATENT AND TRADEMARK OFFICE

CERTIFICATE OF CORRECTION

PATENT NO. : 5,063,926

DATED : November 12, 1991

INVENTOR(S) : R. David Forsgren et al.

It is certified that error appears in the above-identified patent and that said Letters Patent is hereby corrected as shown below:

At column 3, lines 9-10, for "invent" read --invention--.

At column 4, line 5, for "10," read --10'--.

At column 5, line 45, for "ar" read --are--.

At column 5, in claim 1(d), line 55, after "substantially" insert --cylindrical filter element enclosed--.

Signed and Sealed this

Fifteenth Day of June, 1993

*Attest:*

*Attesting Officer*

Michael K. Kirk

MICHAEL K. KIRK

*Acting Commissioner of Patents and Trademarks*